364-423 SR
2/4/86 XR 4,568,823

United States Patent [19]

Diehl et al.

[11] Patent Number: 4,568,823

[45] Date of Patent: Feb. 4, 1986

[54] DIGITAL BALLISTIC COMPUTER FOR A FIRE GUIDANCE SYSTEM

[75] Inventors: Reiner Diehl, Ottersberg-Fischerhude; Uwe Paczula, Wilhelmshaven; Reinhard Schröder, Delmenhorst, all of Fed. Rep. of Germany

[73] Assignee: Fried. Krupp Gesellschaft mit beschränkter Haftung, Essen, Fed. Rep. of Germany

[21] Appl. No.: 511,866

[22] Filed: Jul. 6, 1983

[30] Foreign Application Priority Data

Jul. 7, 1982 [DE] Fed. Rep. of Germany ..... 3225395

[51] Int. Cl.[4] ..... G06F 15/58; F41G 3/04

[52] U.S. Cl. ..... 235/404; 364/423

[58] Field of Search ..... 364/423; 235/404, 409, 235/411, 412

[56] References Cited

U.S. PATENT DOCUMENTS

| | | | |
|---|---|---|---|
| 3,339,457 | 9/1967 | Pun | 235/404 |
| 3,575,085 | 4/1971 | McAdam, Jr. | 235/404 |
| 3,743,818 | 7/1973 | Marasco et al. | 235/404 |
| 3,748,447 | 7/1973 | Hajicek et al. | 364/723 |
| 4,001,565 | 1/1977 | Kawai | 364/723 |
| 4,011,789 | 3/1977 | Breese, Jr. et al. | 235/404 X |
| 4,181,966 | 1/1980 | Wenninger et al. | 364/715 |
| 4,231,097 | 10/1980 | Shibayama et al. | 364/723 X |
| 4,449,041 | 5/1984 | Girard | 235/412 |

FOREIGN PATENT DOCUMENTS

| | | | |
|---|---|---|---|
| 2098705 | 11/1982 | United Kingdom | 364/423 |

*Primary Examiner*—Felix D. Gruber
*Attorney, Agent, or Firm*—Spencer & Frank

[57] ABSTRACT

Digital ballistic computer for the fire guidance system of a tubular weapon which calculates, based on given firing data from firing tables, the ballistic data of the projectile path, composed of a digital memory unit storing data constituting discrete firing table values for each type of ammunition intended for use in the tubular weapon, the stored data corresponding directly to data contained in firing tables, and an approximation computer connected to access the memory unit, and to receive inputted firing data and operative for determining ballistic data, from the stored data and the inputted data, by approximation operations.

8 Claims, 4 Drawing Figures

| 0 | | I | | | II | | | III | | | |
|---|---|---|---|---|---|---|---|---|---|---|---|
| R (m) | ε | Δε 800 (mbar) | 900 (mbar) | p 1100 (mbar) | Δε -40°C' | -10°C' | T -50°C' | Δε 10 m/s | -10 m/s | 20 m/s | v -20 m/s |
| 100 | 0,18 | -0,000 | -0,000 | 0,000 | 0,000 | 0,000 | -0,000 | -0,000 | 0,000 | -0,000 | 0,000 |
| 200 | 0,37 | -0,000 | -0,000 | 0,000 | 0,000 | 0,000 | -0,000 | -0,000 | 0,000 | -0,000 | 0,000 |
| 300 | 0,56 | -0,001 | -0,001 | 0,001 | 0,001 | 0,000 | -0,000 | -0,000 | 0,000 | -0,000 | 0,000 |
| 400 | 0,74 | -0,002 | -0,001 | 0,001 | 0,002 | 0,001 | -0,001 | -0,000 | 0,000 | -0,000 | 0,000 |
| 500 | 0,93 | -0,003 | -0,001 | 0,001 | 0,003 | 0,001 | -0,001 | -0,000 | 0,000 | -0,000 | 0,000 |
| 600 | 1,12 | -0,004 | -0,002 | 0,002 | 0,004 | 0,002 | -0,002 | -0,000 | 0,000 | -0,000 | 0,000 |
| | | | -0,003 | 0,003 | 0,005 | 0,002 | -0,003 | -0,000 | 0,000 | -0,000 | 0,000 |
| | | | | | | ,003 | -0,004 | -0,000 | 0,000 | -0,001 | 0,001 |
| | | | | | | | -0,005 | -0,000 | 0,000 | -0,001 | 0,001 |
| | | | | | | | | | | -0,001 | 0,001 |

| 0 | | I | | | II | | | III | | | |
|---|---|---|---|---|---|---|---|---|---|---|---|
| R (m) | $t_F$/s | $\Delta t_F$ 800 (mbar) | 900 (mbar) | p 1100 (mbar) | $\Delta t_F$ -40°C | -10°C | T 50°C | $\Delta t_F$ 10 m/s | -10 m/s | 20 m/s | v -20 m/s |
| 100 | 0,061 | -0,000 | -0,000 | 0,000 | 0,000 | 0,000 | -0,000 | -0,000 | 0,000 | -0,000 | 0,000 |
| 200 | 0,122 | -0,000 | -0,000 | 0,000 | 0,000 | 0,000 | -0,000 | -0,000 | 0,000 | -0,000 | 0,000 |
| 300 | 0,183 | -0,000 | -0,000 | 0,000 | 0,000 | 0,000 | -0,000 | -0,000 | 0,000 | -0,000 | 0,000 |
| 400 | 0,245 | -0,000 | -0,000 | 0,000 | 0,000 | 0,000 | -0,000 | -0,000 | 0,000 | -0,000 | 0,000 |
| 500 | 0,306 | -0,001 | -0,000 | 0,000 | 0,001 | 0,000 | -0,000 | -0,000 | | | |
| 600 | 0,369 | -0,001 | -0,001 | 0,001 | 0,001 | 0,0 | | | | | |
| 700 | | | | | | | | | | | |

Fig.2

DIGITAL BALLISTIC COMPUTER FOR A FIRE GUIDANCE SYSTEM

BACKGROUND OF THE INVENTION

The present invention relates to a digital ballistic computer for the fire guidance system for a tubular weapon.

In order to calculate the ballistic data, such as tangent elevation and lead of the tubular weapon or flight time of the projectile in dependence on the actual firing data, such as distance of the target, type of ammunition and environmental parameters, e.g. barometric pressure, air temperature, head wind velocity, etc., the manufacturer of ammunition prepares so-called firing tables for every type of ammunition which contain tangent elevation, flight time and lead for discrete distances under fixed environmental conditions or environmental parameters. These environmental conditions correspond, for example, to the ICAO [International Civil Aviation Organization] atmosphere and are the so-called standard conditions. Environmental parameters deviating from the standard conditions are considered to be mutually independent and are listed in the firing tables as correction values.

Known ballistic computers calculate the ballistic data by reproducing, as accurately as possible, continuous functions which approximate firing table data under standard conditions in that these functions either form the basis of the circuit design in analog computers or the basis of the realized program in digital computers, the latter case involving the programming of formulas for the calculation of tangent elevation, lead and flight time in hardware and software. The structure of these functions approximating the firing table data is applicable to all types of ammunition, while coefficients contained in the functions are applicable, on the one hand, only for one type of ammunition and, on the other hand, must be varied according to the correction values if there are environmental parameters which deviate from the standard conditions.

The use of a single structure of the functions for all types of ammunition is a drawback inasmuch as it is impossible to approximate with sufficient accuracy all firing tables applicable for different types of ammunition in a single structure. The result is that, on the one hand, the calculated ballistic data are of different accuracy for different types of ammunition and, on the other hand, the tubular weapon can be retrofitted for a new type of ammunition only if the existing function structure is able to also approximate with sufficient accuracy the firing tables for the new type of ammunition without additional coefficients, which is possible only in the rarest of cases.

Moreover, the problem often arises that the firing tables produced for the first ammunition are changed in the course of time, with respect to number and type as well as value of the firing table parameters. Such changes can be made in the ballistic computer only with considerable changes in hardware and software.

A further drawback in the known ballistic computers is the convergence behavior of the approximation procedures. This behavior depends on the selected structure of the functions and on additionally required approximation parameters, such as, for example, the starting values. Since the optimizing problems are often nonlinear, it is very time consuming to find a satisfactory solution.

SUMMARY OF THE INVENTION

It is an object of the present invention to provide a digital ballistic computer of the above-mentioned type which, with sufficient accuracy in the calculation of the ballistic data, is flexible with respect to all changes in the firing tables and also with respect to the exchange of types of ammunition or the retrofitting with new types of ammunition.

The above and other objects are achieved, according to the invention, by the provision of a digital ballistic computer for the fire guidance system of a tubular weapon which calculates, based on given firing data from firing tables, the ballistic data of the projectile path, which computer includes a digital memory unit storing data constituting discrete firing table values for each type of ammunition intended for use in the tubular weapon, the stored data corresponding directly to data contained in firing tables, and an approximation computer connected to access the memory unit, and to receive inputted firing data and operative for determining ballistic data, from the stored data and the inputted data, by approximation operations.

In the ballistic computer according to the invention, the ballistic data are computed by directly using the firing tables applicable for the respective type of ammunition and not functions which only approximate these firing tables. In this way, no complicated approximation of the firing tables is necessary and, on the other hand, only very small approximation errors occur in the approximation computer. The accuracy of the ballistic data put out by the ballistic computer is just as good as the firing tables. When a type of ammunition is introduced, it is merely necessary to exchange or insert corresponding memory elements into the memory unit. Changes in the approximation computer itself or in its calculating program are not required. The data contained in the firing tables can be stored directly, i.e. unchanged, as firing table values. For better utilization of the dynamic range of the memory unit, however, it is of advantage not to use the original firing table data as the firing table values but derive individual values from the firing table data, e.g. by way of logarithming or standardizing, and to store the thus derived values as firing table values.

In accordance with preferred embodiments of the invention, the memory unit also stores additional information data about the structure and extent of the firing tables, including the first table parameters. Preferably, the data are stored separately as standard and supplemental values and, together with associated information data, form a set of firing table data which is applicable for one respective type of ammunition.

With these firing table information data, the stored firing table values can be processed in the approximation computer with the aid of a general computer program. Since this computer program depends only on the structure of the firing table data sets and not on their content, it is accomplished that, upon a change in the firing tables, e.g. upon introduction of a new type of ammunition with possibly new or additional parameters, no program changes are required.

In accordance with the invention, the digital memory unit is constituted by a fixed value memory, preferably composed of replaceable memory elements, such as PROM's. A firing data set applicable to one respective type of ammunition is stored in each respective memory element.

By associating complete firing table data sets with spatially separate memory chips, exchange, or increases in the number, of firing table data sets in the memory unit is facilitated.

The present invention will now be explained in greater detail with the aid of an embodiment which is illustrated in the drawings.

BRIEF DESCRIPTION OF THE DRAWINGS

FIG. 2 shows parts of firing tables applicable to one type of ammunition.

DESCRIPTION OF THE PREFERRED EMBODIMENTS

Figure 1:
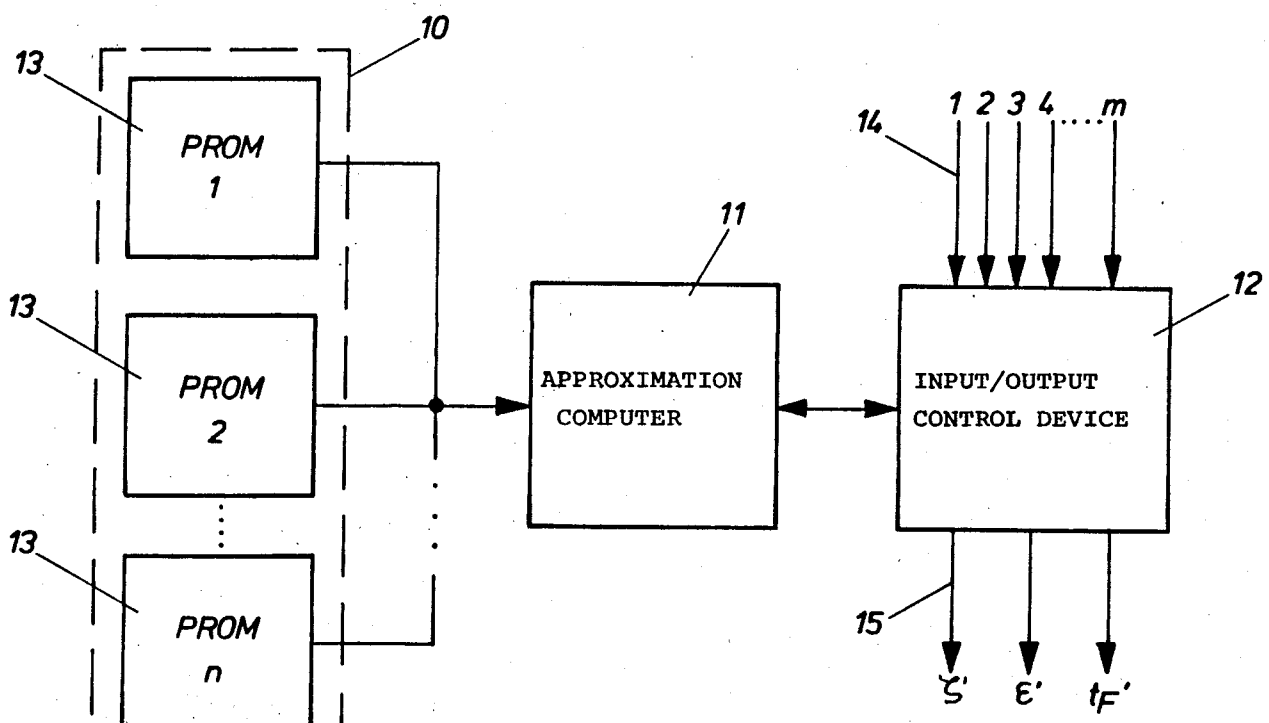
FIG. 1 is a block circuit diagram of a digital ballistic computer.

The digital ballistic computer shown in the block circuit diagram of FIG. 1 for the fire guidance system of a tubular weapon includes a memory unit 10, an approximation computer 11 which accesses the memory unit 10 and an input/output control device 12 which controls the flow of input and output data to and from the approximation computer 11. The memory unit 10 is subdivided into a plurality of memory elements or memory chips 13 which are designed to be spatially separated from one another. Each memory chip 13 may be constituted, for example, by a PROM.

In order to calculate the ballistic data, such as tangent elevation and lead of the tubular weapon and flight time of the projectile, the manufacturer of the ammunition furnishes so-called firing tables for each type of ammunition intended for the tubular weapon in question.

For example, in the firing table O shown at the top of FIG. 2, the tangent elevation angle $\epsilon$ is given, for example, as a function of the distance to the target R. This relation is applicable under so-called standard conditions. These standard conditions correspond to fixed typical environmental and ammunition parameters, e.g. the ICAO conditions, and assume a certain air and explosive powder temperature, a certain barometric pressure and a certain muzzle velocity. Deviations of this ballistic data due to deviations from the standard conditions of the environmental parmeters are listed as correction values in so-called supplemental tables, such as the tables I, II and III of FIG. 2.

The ballistic data listed in standard table O, i.e. in column $\epsilon$, must be changed by the correction values listed in supplemental tables I through III, and the correction values in the different supplemental tables are considered to be mutually independent. The firing tables at the bottom of FIG. 2 include a standard table O of the flight time of the projectile in dependence on the distance to the target under standard conditions, while supplemental tables I through III again provide the corresponding correction values for environmental parameters which deviate from the above.

These discrete data of the firing tables are contained in the memory unit 10 as discrete firing table values, with the firing tables applicable for different types of ammunition being stored in separate memory chips 13. The discrete firing table values may here be the data themselves as contained in the firing tables—as will be described in the example below—or they may be derived individually from these data, e.g. by logarithming or standardizing. In addition to these firing table values, the individual memory chips 13 contain additional information data regarding the structure and extent of stored firing table values, each time in association with the firing table values applicable for a particular type of ammunition. These information data include identification of the ammunition, length of firing table (number of distance steps), number of firing table parameters, number of values in each supplemental table for each parameter and distance step, magnitudes of those values, scales and control words for association of environmental parameters with the additional tables. The stored discrete firing table values from the standard tables (standard values), the supplemental tables (supplemental values) and the stored information data form a so-called firing table data set applicable for one type of ammunition and stored completely in one memory chip 13.

Processing of the stored firing table values is effected in approximation computer 11 by means of a conventional general calculating program. The actual firing data, such as distance of the target, and environmental parameters, such as barometric pressure, head and cross wind speeds, are available at the inputs 14 of the input/output control device 12 and are fed from there to the approximation computer 11. The approximation computer 11 is designed in such a way that it locates, from the discrete firing table values, and stored table values around the actual firing data values fed in and determines the ballistic data from the read-out stored values by multi-dimensional interpolation.

Figure 3:
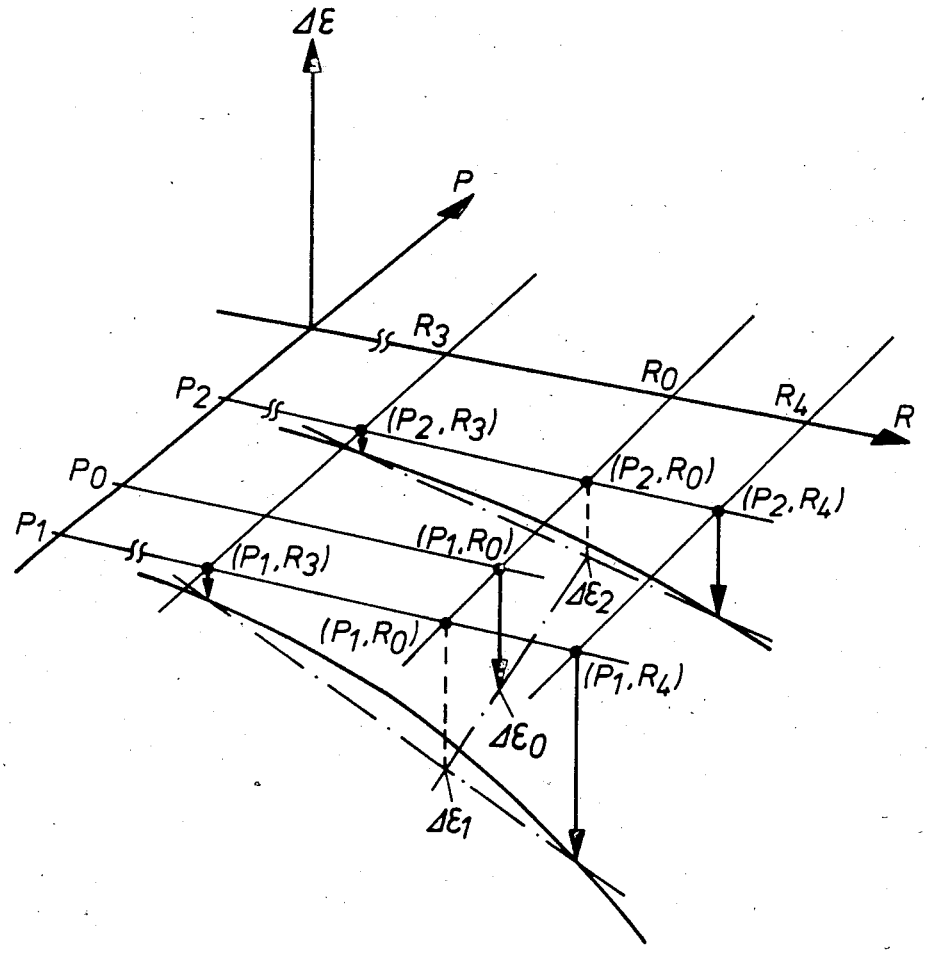
FIG. 3 is a graphic representation of a multidimensional interpolation procedure according to the invention.

FIG. 3 is a graphic representation of such a multidimensional interpolation procedure in the approximation computer 11 for a target distance, or range, $R_0$ and a barometric pressure $p_0$ for a determination of the change in the tangent elevation angle $\Delta\epsilon$ as a correction value for the tangent elevation angle $\epsilon$ associated with the target distance $R_0$. The multidimensional interpolation is realized here by repeated single dimensional interpolation.

Initially, the approximation computer 11 determines the ballistic data from the actual firing data supplied, as starting values for the standard tables in dependence on the target distance $R_0$ fed in. This is done by linear interpolation between the two adjacent firing table values.

In the example outlined by solid lines in FIG. 3, this results in the tangent elevation $\epsilon_0$ for the standard conditions from the firing table values corresponding to the standard table O for a target distance $R_0$ which lies between the distances $R_3=500$ m and $R_4=600$ m.

Then, a respective supplemental value $\Delta\epsilon_0$ for the tangent elevation angle $\epsilon_0$ as influenced by environmental parameters is determined separately for each parameter. In the example shown in FIG. 3, the influence of barometric pressure p on tangent elevation is considered, with the actual barometric pressure $p_0$ being assumed to lie between the barometric pressure values $p_1$ and $p_2$, which represent barometric pressure values stored in the firing table data set and shown in the hatched region in FIG. 2. The actual target distance $R_0$ lies between stored values $R_3$ and $R_4$. The four stored values associated with points $p_1$, $p_2$, $R_3$ and $R_4$ are read out and processed in the approximation computer 11 in a repeated, single dimensional linear interpolation, the result being the change in tangent elevation $\Delta\epsilon_0$ that must actually be considered, which is added to the determined tangent elevation angle $\epsilon_0$ corresponding to range $R_0$ and is obtained as the actual tangent elevation angle $\epsilon'_0$ at one of the outputs 15 of the input/output control device 12.

In the example shown in FIG. 3 for repeated single dimensional linear interpolation, a linear interpolation first takes place between the values associated with coordinates $P_1$, $R_3$ and $P_1$, $R_4$, on the one hand, and between the values associated with coordinates $P_2$, $R_3$ and $P_2$, $R_4$, on the other hand. The intermediate results are the changes in tangent elevation $\Delta\epsilon_1$ and $\Delta\epsilon_2$ at $P_1$, $R_0$ and $P_2$, $R_0$. A new linear interpolation is made between these two values and the result is the change in tangent elevation $\Delta\epsilon_0$ with respect to barometric pressure at $P_0$, $R_0$.

This same interpolation procedure is performed for all other environmental parameters, e.g. temperature of the air T, head wind velocity v, muzzle velocity deviation $\Delta v_0$, etc. The total tangent elevation $\epsilon'_0$ then results from the sum of all individual values $\Delta\epsilon_0$ plus the determined tangent elevation angle $\epsilon_0$. For the other two ballistic data, such as lead angle $\tau$ and flight time of the projectile $t_F$, the same interpolation procedure is effected between corresponding firing table values. The actual ballistic data determined for the actual firing data, i.e. tangent elevation angle $\epsilon'$, lead angle $\tau'$ and flight time of the projectile $t_F'$, can each be obtained at one of the outputs 15 of the input/output control device 12.

In the example shown in FIG. 3 the solid-line, arcuate curves represent the real continous changes in tangent elevation $\Delta\epsilon$ as a function of the target distance R. These curves are drawn with respect to a second parameter the barometric pressure P. But as it is impossible to store continuous curves completely, they are represented in the firing table by discrete values of which four are shown at the coordinates $P_1$, $R_3$; $P_1$, $R_4$; $P_2$, $R_3$ and $P_2$, $R_4$. The intermediate values of the changes in tangent elevation $\Delta\epsilon_1$ and $\Delta\epsilon_2$ are gained by linear interpolation. But this means an approximation of the real curve of $\Delta\epsilon$ by straight lines shown as dot-dash straight lines in FIG. 3. A similar dot-dash line represents the interpolation between $\Delta\epsilon_1$ and $\Delta\epsilon_2$ to determine the changes in tangent elevation $\Delta\epsilon_0$ at the coordinates $P_0$, $R_0$.

The present invention is not limited to the abovedescribed embodiment. It is not obligatory, for example, for the approximation computer 11 to determine the ballistic data from the firing table values by linear interpolation. Rather, other types of approximation calculations can also be used, for example extrapolation, in which interpolation or extrapolation, respectively, can be effected in accordance with various known methods, as for example by polynomials of the first order or of a higher order, spline approximation or according to the method of the least mean square errors. In this way, the deviation of the thus calculated tangent elevation, lead and flight time values from the theoretically desired ballistic values can be made as small as desired.

A computer which can serve as an approximation computer 11 is well known. It comprises for instance a microprocessor ID 8085 A and as peripheral equipment for this microprocessor an arithmetic processor MD 8231 A, a random access memory MD 2114 A and a program memory MD 2732 A, all integrated circuits manufactured by Intel Corp. Santa Clara, Calif., and connected to each other as it is recommended by the manufacturer.

The input/output device 12 is well known, see for instance the input/output circuit ID 8255 A from Intel Corp. in combination with the multiplexer HI 1-505-2 from Harris Semiconductor, Melbourne, Fla., to multiplex the m input channels shown in FIG. 1.

Figure 4:
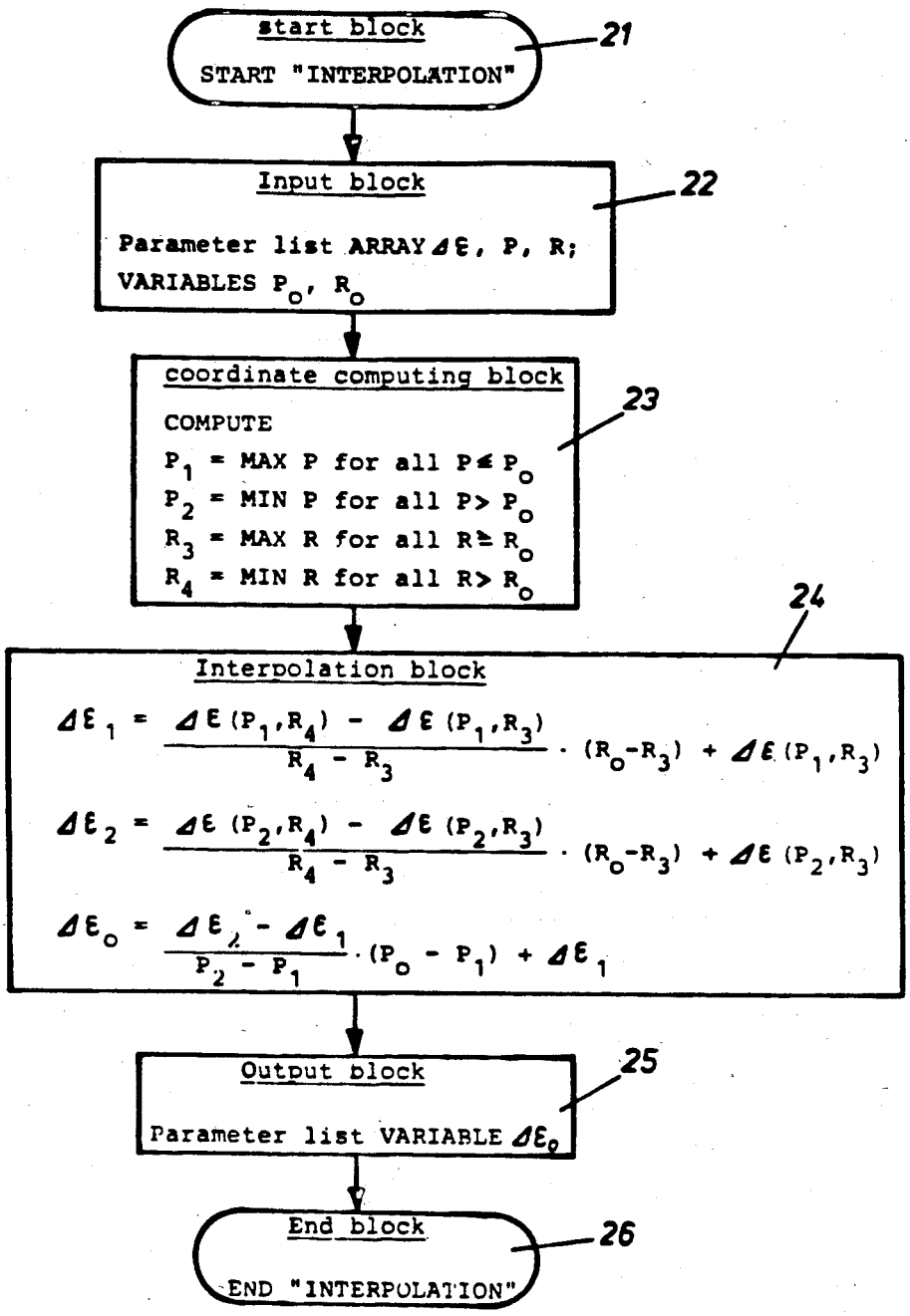
FIG. 4 shows a programming flow diagram of an interpolation procedure.

The programming flow diagram of FIG. 4 shows how an interpolation procedure is carried out by the approximation computer 11 of FIG. 1. This interpolation procedure is a simple straight down programmed procedure and is activated by a usual start block 21. An input block 22 is connected to the start block 21 to declare the arrays $\Delta\epsilon$, P and R and the simple variables $P_0$ and $R_0$ which are used for data transfer operations between main program and interpolation procedure. The array $\Delta\epsilon$ is a two dimensional array for the firing data table and its two index variables are determined as coordinates in a coordinate computing block 23. These coordinates $P_1$, $P_2$, $R_3$, and $R_4$ are the upper and the lower values closest to the actual firing data $P_0$ and $R_0$ of the values of barometric pressure P and distance R of the firing data table and they are computed by the equations (1) to (4)

$$P_1 = \text{MAX } P \text{ for all } P \leqq P_0 \tag{1}$$

$$P_2 = \text{MIN } P \text{ for all } P > P_0 \tag{2}$$

$$R_1 = \text{MAX } R \text{ for all } R \leqq R_0 \tag{3}$$

$$R_3 = \text{MIN } R \text{ for all } R > R_0 \tag{4}$$

shown in the coordinate computing block 23 where by the function MAX the maximum value and by the function MIN the mininum value of P or R are determined according to the condition behind. The coordinates $P_1$, $P_2$, $R_3$ and $R_4$ are used to determine the corresponding four changes in tangent elevation $\Delta\epsilon(P_1, R_4)$, $\Delta\epsilon(P_1, R_3)$, $\Delta\epsilon(P_2, R_4)$, and $\Delta\epsilon(P_2, R_3)$ from the firing table stored as double indexed array $\Delta\epsilon$.

The changes in tangent elevation are now interpolated in the interpolation block 26 first with respect to the distance coordinate R to get the intermediate results $$\Delta\epsilon_1 = \frac{\Delta\epsilon(P_1,R_4) - \Delta\epsilon(P_1,R_3)}{R_4 - R_3} \cdot (R_0 - R_3) + \Delta\epsilon(P_1,R_3) \tag{5}$$

and $$\Delta\epsilon_2 = \frac{\Delta\epsilon(P_2,R_4) - \Delta\epsilon(P_2,R_3)}{R_4 - R_3} \cdot (R_0 - R_3) + \Delta\epsilon(P_2,R_3). \tag{6}$$

The interpolation between the intermediate values $\Delta\epsilon_1$ and $\Delta\epsilon_2$ results in the change in tangent elevation $$\Delta\epsilon_0 = \frac{\Delta\epsilon_2 - \Delta\epsilon_1}{P_2 - P_1} (P_0 - P_1) + \Delta\epsilon_1 \tag{7}$$

with respect to the actual firing data $P_0$ and $R_0$. In an output block 27 an output parameter list is declared to return the change in tangent elevation $\Delta\epsilon_0$ to the main program of the approximation computer 11.

The interpolation procedure is terminated with the usual end block 28.

It will be understood that the above description of the present invention is susceptible to various modifications, changes and adaptations, and the same are intended to be comprehended within the meaning and range of equivalents of the appended claims.

What is claimed is:

1. Digital ballistic computer for the fire guidance system of a tubular weapon which calculates, based on given firing data from firing tables, the ballistic data of the projectile path, comprising: a digital memory unit storing data constituting discrete firing table values for at least one type of ammunition intended for use in the tubular weapon, the stored data corresponding directly to data contained in firing tables, said digital memory unit comprising a first group of memory locations storing data representing standard firing table values corresponding to predetermined standard environmental conditions, a second group of memory locations storing data representing firing table deviation values corresponding to deviations from the predetermined standard environmental conditions, and a third group of memory locations storing data representing additional information relating to the structure and extent of the firing tables, including firing table length and the number of firing table parameters, whereby the data stored in said first, second and third groups of memory locations form a set of firing table data associated with one respective type of ammunition; and an approximation computer connected to access said memory unit, and to receive inputted firing data and operative for determining ballistic data, from the stored data and the inputted data, by approximation operations.

2. Ballistic computer as defined in claim 1, wherein said digital memory unit comprises a fixed value memory.

3. Ballistic computer as defined in claim 2 wherein said fixed value memory comprises exchangeable memory elements.

4. Ballistic computer as defined in claim 3 wherein said exchangeable memory elements are PROM's.

5. Ballistic computer as defined in claim 3 wherein a firing data set applicable to one respective type of ammunition is stored in each respective memory element.

6. Ballistic computer as defined in claim 1 further comprising a control device connected to said approximation computer for controlling the transfer of input and output data of the approximation computer and having inputs for receiving the inputted firing data and outputs while providing the resulting ballistic data.

7. Ballistic computer as defined in claim 6 wherein said approximation computer operates by searching among the stored data for the stored discrete firing table values adjacent the inputted firing data it receives at its input and determines the ballistic data from the read-out stored data by multidimensional interpolation.

8. Ballistic computer as defined in claim 7 wherein the multidimensional interpolation is a repeated single dimensional interpolation between the stored values.

* * * * *